US011059157B2

(12) United States Patent
Fu et al.

(10) Patent No.: US 11,059,157 B2
(45) Date of Patent: Jul. 13, 2021

(54) IMPACT HAND TOOL

(71) Applicant: Changzhi Fu, Tangshan (CN)

(72) Inventors: Changzhi Fu, Tangshan (CN); Yuxuan Fu, Tangshan (CN)

(73) Assignee: Changzhi Fu, Tangshan (CN)

( * ) Notice: Subject to any disclaimer, the term of this patent is extended or adjusted under 35 U.S.C. 154(b) by 282 days.

(21) Appl. No.: 16/424,293

(22) Filed: May 28, 2019

(65) Prior Publication Data

US 2019/0358800 A1 Nov. 28, 2019

(30) Foreign Application Priority Data

May 28, 2018 (CN) ..... 201820801775.2

(51) Int. Cl.
*B25F 1/02* (2006.01)
*B25F 1/00* (2006.01)
*B25D 3/00* (2006.01)

(52) U.S. Cl.
CPC ..... *B25F 1/02* (2013.01); *B25D 3/00* (2013.01); *B25F 1/006* (2013.01)

(58) Field of Classification Search
CPC ... B25F 1/02; B25F 1/006; B25D 3/00; B25D 2222/57; B25D 2250/111; B25D 2250/241
USPC ..... 125/41; 30/167–172, 329–344; 81/22, 81/27
See application file for complete search history.

(56) References Cited

U.S. PATENT DOCUMENTS 1,067,658 A * 7/1913 Joyce ..... B23D 59/006 30/123.3
2,701,359 A * 2/1955 Asbury ..... B25D 1/00 227/147
3,399,928 A * 9/1968 Robbins ..... B25D 17/02 299/37.4
3,735,824 A * 5/1973 Astrom ..... B23Q 1/015 175/213
4,624,323 A * 11/1986 Burrola ..... B25B 15/001 173/128
5,370,192 A * 12/1994 Evinger ..... B25D 1/16 173/132
7,191,685 B2 * 3/2007 Lowther ..... B21D 1/06 81/27

(Continued)

OTHER PUBLICATIONS

STIC Search Report (Year: 2021).*

*Primary Examiner* — Monica S Carter
*Assistant Examiner* — Michael A Gump
(74) *Attorney, Agent, or Firm* — Novoclaims Patent Services LLC; Mei Lin Wong

(57) ABSTRACT

An impact hand tool which includes an outer sleeve; an impact rod inserted to connect to the outer sleeve; a cushion pad provided inside the outer sleeve at the vertical center axis; a handle connected to the impact rod; an inner hole slot at a second end of the outer sleeve with an inner wall and an internal thread; and a tool head installed to the outer sleeve through the inner hole slot. The tool head comprises a one-piece structure of a working rod portion and a working head, a connecting rod having an external thread for coupling with the inner hole slot, a connecting sleeve connected to the connecting rod to form an integral and stepped hollow body defining a connecting cavity to receive the working rod portion, and a rubber filler to fill a gap between the working rod portion and the inner wall of the connecting rod.

8 Claims, 3 Drawing Sheets

(56) References Cited

U.S. PATENT DOCUMENTS

| | | | | |
|---|---|---|---|---|
| 9,868,202 | B1 * | 1/2018 | Burcham | B25F 1/02 |
| 2012/0180200 | A1 * | 7/2012 | Gaudet | A42B 3/121 2/411 |

* cited by examiner

IMPACT HAND TOOL

CROSS REFERENCE OF RELATED APPLICATION

This is a non-provisional application which claimed priority of Chinese application number 201820801775.2, filing date May 28, 2018. The contents of this specification are incorporated herein by reference.

BACKGROUND OF THE PRESENT INVENTION

Field of Invention

The present invention relates a hand tool, and particularly to a split-type impact hand tool.

Description of Related Arts

At present, the hand tool for punching is mainly a chisel, which is composed of a chisel head, a chisel rod and a tail portion, and is usually made of round steel or hexagonal hollow carbon steel. The chisel has a certain hardness and a blade angle (such as a bar shape and a cross shape), and is used with a hammering tool such as a hammer to beat the tail portion to improve the chiseling effect. The common chiseling structure for impacting is relatively simple. When used for a long time, the tail portion which is impacted is not only easy to deform, but also affecting the impact effect and efficiency. Also, tail deformation is prone to slippery hammer, which causes the tool such as the hammer to slip and rub the hand or smash the object. The precision is low and the risk is high.

In addition, the existing working head of the impact hand tool is integrated with the impact rod. When working in different working environments, it is necessary to use impact tools of various structures or shapes, and there are many types of tools to be carried, which are not easy for handling, transportation and storage.

The impact head and the power body of the electric impact tool or pneumatic impact tool are separate and are replaceable, but they are plug-type structures. This type of connection is too loose and is not suitable for manual impact operation.

SUMMARY OF THE PRESENT INVENTION

In order to solve the problems of existing arts, an object of the present invention is to provide a combination type impact hand tool of which a plurality of tool heads can be assembled or dissembled easily for use under different working environments.

Additional advantages and features of the invention will become apparent from the description which follows, and may be realized by means of the instrumentalities and combinations particular point out in the appended claims.

According to the present invention, the foregoing and other objects and advantages are attained by the followings:

An impact hand tool, comprising:

an outer sleeve having a central opening at a first end open through to a sleeve receiving cavity and defining a vertical center axis;

an impact rod inserted to the sleeve receiving cavity through the central opening at the first end;

a cushion pad provided inside the outer sleeve at the vertical center axis; and a handle connected to a free end of the impact rod;

an inner hole slot provided at a second end of the outer sleeve, which has a hollow body and comprises an inner wall and an internal thread on the inner wall of the inner hole slot; and a tool head installed to the second end of the outer sleeve to secured into position.

Preferably, the tool head comprises a connecting rod, a working head, a connecting sleeve and a working rod portion connecting together to form an integral structure, the connecting rod and the connecting sleeve connected together to form an integral and stepped hollow body defining a connecting cavity, the connecting rod has an outer wall on which an external thread for coupling with the internal thread of the inner hole slot is provided, the connecting sleeve has a connecting sleeve outer wall with an anti-slip surface, the working head and the working rod is a one-piece structure, the working rod portion is inserted into connecting cavity of the integral and stepped hollow body formed by the connecting rod and the connecting sleeve, and a rubber filler is provided to fill a gap between the working rod portion and the inner wall of the connecting rod.

The impact head provided at one end of the impact rod inside the outer sleeve has a tapered structure, the impact rod and the impact head is a one-piece structure, and an outer diameter of the large diameter end of the impact head is larger than an inner diameter of the central opening at a moveable end of the outer sleeve.

Preferably, the cushion pad is a rubber pad having a shape selected from the group consisting of a circular shape, a square shape and a plum shape, and has an overall thickness of 3-10 mm and a periphery portion adhered to the inner wall of the outer sleeve.

Preferably, the working head is a shovel body having a flat trapezoidal structure, a cutting edge provided at a front end thereof, and a working hole provided at a junction between the working head and the connecting rod.

Preferably, the working head is a shovel body having a flat polygonal structure, a concave cutting edge with a curvature of 150-170° provided at a front end thereof, and a working hole provided at a junction between the working head and the connecting rod.

Preferably, the working head is a prismatic structure with a polygonal cross-section, and a working hole provided at a junction between the working head and the connecting rod.

Preferably, the working head has a triangular pyramid or a quadrangular pyramid structure.

Preferably, the inner hole slot has a bottom portion and a filler layer having a thickness of 1-3 mm for buffering is provided at the bottom portion of the inner hole slot.

Preferably, an end plate is provided at the free end of the connecting rod, and a central portion of the end plate is an outward circular protrusion; a length of the working rod is greater than a length of the connecting rod by 0.5-1 mm and a protruded portion of the working rod is defined and positioned inside the outward circular protrusion; the outward circular protrusion is in direct contact with the cushion pad.

Compared to the existing arts, the impact hand tool of the present invention provides an innovative improvement. The impact rod and the tool head are constructed to a split-type structure which can be assembled or disassembled easily and therefore the tool head can be replaced easily. The impacting body (which is the impact rod) and the impacted head (which is the tool head) are connected together by thread connection, the connecting material is plastic, and the cushion pad is provided at the action surface of the impact rod and the impact head. Since the threaded portions only bear a small inertial force from the outer sleeve while the thread is a plastic structure, once the threaded portions are tightened manually together, they will not loosen by the vibration during working. In addition, the elasticity of the cushion pad can greatly reduce the reaction force of the tool head on the impact rod, so that the impact force is heavier and the impact effect is better. For example, the impact effect is especially good when the impact hand tool is used for hacking firewood and cutting ice hole. The tool heads with different strengths and shapes can be replaced at any time according to different working environments, and the act of changing tool head is easy and fast, the transportation and storage is convenience and the application range is wide, capable of forming a series of kits with low cost and high efficiency.

Still further objects and advantages will become apparent from a consideration of the ensuing description and drawings.

These and other objectives, features, and advantages of the present invention will become apparent from the following detailed description, the accompanying drawings, and the appended claims.

NUMERICAL REFERENCE IN THE DRAWINGS

1: handle; 2: impact rod; 3: outer sleeve; 4: impact head; 5: cushion pad; 6: tool head; 7: inner hole slot; 6-1: connecting rod; 6-2: working head; 6-3: connecting sleeve; 6-4: working rod portion.

DETAILED DESCRIPTION OF THE PREFERRED EMBODIMENT

The present invention is further described with the accompanying drawings as follows.

Figure 1:
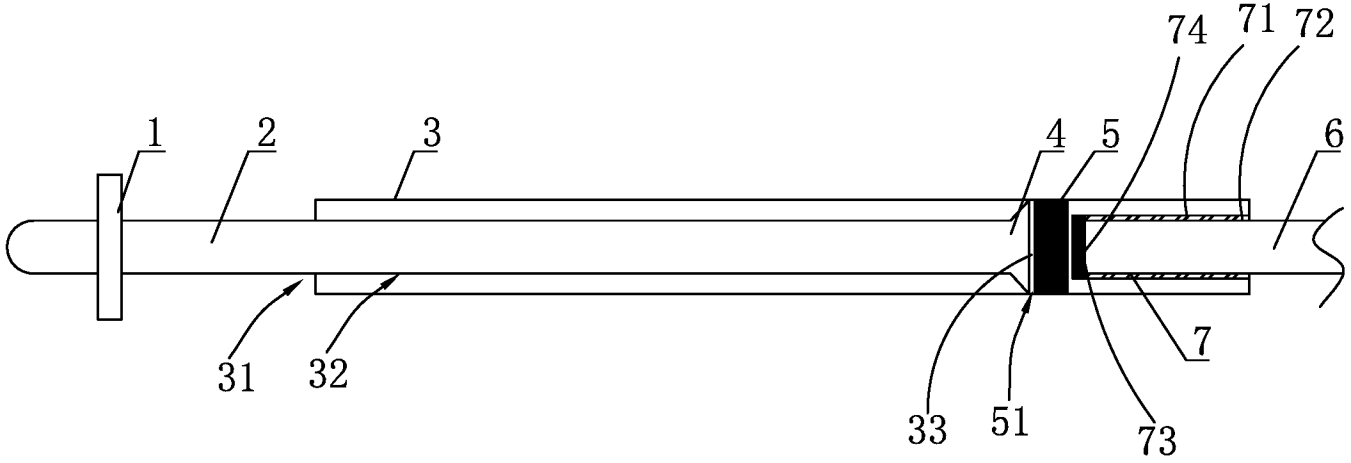
FIG. 1 is a schematic diagram of the impact hand tool according to a preferred embodiment of the present invention.

Referring to FIG. 1 of the drawings, the split-type impact hand tool of the present invention includes a handle 1, an impact rod 2, an outer sleeve 3, an impact head 4, a cushion pad 5, a tool head 6 and an inner hole slot 7.

The outer sleeve 3 has a central opening 31 at a first end opened through to a sleeve receiving cavity 32. The impact rod 2 is inserted into the sleeve receiving cavity 32 through the central opening 31 of the outer sleeve 3. The cushion pad 5 is provided inside the outer sleeve 3 at a vertical center axis. The cushion pad 5 is a rubber pad having a shape of one of a circular shape, a square shape or a plum shape and an overall thickness of 3-10 mm, and has a periphery portion 51 adhered to an inner wall 33 of the outer sleeve 3. The thickness of the cushion pad 5 may be varied based on a length of the impact rod 2. The periphery portion 51 of the cushion pad 5 is glued to the inner wall 33 of the outer sleeve 3 so that the outer sleeve 3 and the cushion pad 5 are bonded together to form an integrated body. The tool head 6 is installed to a second end of the outer sleeve 3 through the inner hole slot 7 provided at the second end of the outer sleeve 3 and internal thread 72 is provided at an inner wall 71 of the inner hole slot 7.

The tool head 6 comprises a connecting rod 6-1, a working head 6-2, a working rod portion 6-4 and a connecting sleeve 6-3. The connecting rod 6-1 and the connecting sleeve 6-3 is integrally connected to form a stepped hollow structure defining a connecting cavity 613. The connecting rod 6-1 has an outer wall 611 and an external thread 612 matching with the internal thread 72 of the inner hole slot 7. The connecting sleeve 6-3 has a connecting sleeve outer wall 631 provided with anti-slip surface 632. The working head 6-2 and a working rod portion 6-4 is a one-piece structure. The working rod portion 6-4 is inserted into the connecting cavity 613 of the stepped hollow structure and a rubber filler 615 is provided to fill the gap between the working rod portion 6-4 and an inner wall 614 of the connecting rod 6-1.

Preferably, the impact head 4 provided at one end the impact rod 2 inside the outer sleeve 3 has a tapered structure. The impact rod 2 and the impact head 4 are a one-piece structure. The impact rod 2 has a free end coupled with a handle 1. The handle 1 is made of rubber material and is bonded to the impact rod 2 to form an integral structure.

The connecting rod 6-1 has a free end and an end plate provided at the free end. The central portion of the end plate is an outward circular protrusion 616. The working rod portion 6-4 has a length greater than a length of the connecting rod 6-1 by 0.5-1 mm. The protruded portion of the working rod portion 6-4 is positioned inside the outward circular protrusion 616. The outward circular protrusion 616 is in direct contact with the cushion pad. When the cushion pad is acted on by an impacting force from the impact head's side, the other side of the cushion pad directly acts on the circular protrusion and the free end of the working rod portion.

The tool head 6 and the outer sleeve 3 are detachably connected together so that different types of tool heads may be selected and installed according to actual needs.

Embodiment 1

Figure 2:
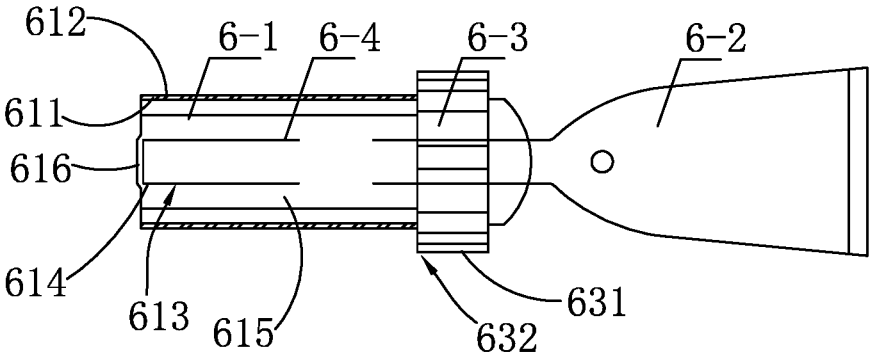
FIG. 2 is a schematic diagram of the head tool according to a first preferred embodiment of the present invention.

Referring to FIG. 2 of the drawings, the working head 6-2 is a shovel body having a flat trapezoidal structure, a cutting edge is provided at a front end and a working hole is provided at a junction between the working head 6-2 and the connecting rod 6-1.

Embodiment 2

Figure 3:
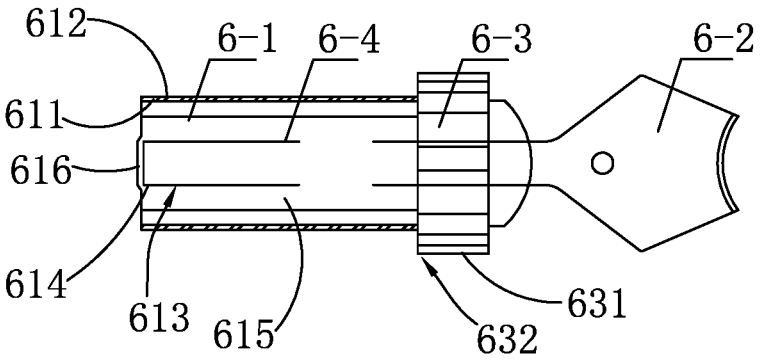
FIG. 3 is a schematic diagram of the head tool according to a second preferred embodiment of the present invention.

Referring to FIG. 3 of the drawings, the working head 6-2 is a shovel body having a flat polygonal structure, a concave cutting edge with a curvature of 150-170° is provided at a front end and a working hole is provided at a junction between the working head 6-2 and the connecting rod 6-1.

Embodiment 3

Figure 4:
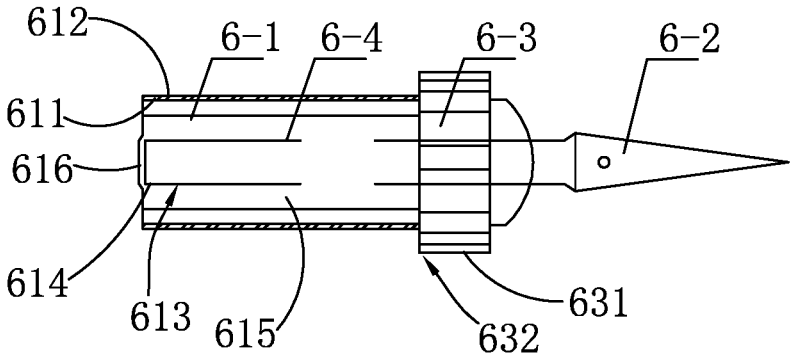
FIG. 4 is a schematic diagram of the head tool according to a third preferred embodiment of the present invention.

Referring to FIG. 4 of the drawings, the working head 6-2 is a prismatic structure with a polygonal cross-section, and a working hole is provided at a junction between the working head 6-2 and the connecting rod 6-1. Preferably, the working head is a triangular pyramid or a quadrangular pyramid.

The inner hole slot 7 has a bottom portion 73 and a filling layer 74 for buffering is provided at the bottom portion 73 of the inner hole slot 7. The filling layer 74 has a thickness of 1-3 mm.

After the tool head 6 is screwed into the inner hole slot 7 through the internal thread and the external thread, the free end of the connecting rod directly presses the filling layer. When the impact head impacts the cushion pad, the entire outer sleeve will carry the tool head to impact on the working part. At the same time, the filling layer can further provide buffering effect and resonance effect to the connecting rod, thus increasing the impact force, reducing the hard fiction between the connecting rod and the inner hole slot, and prolonging the service life of the tool.

The impact hand tool of the present invention is simple and efficient to use, and can effectively avoid injury or inaccurate point of contact. The application of the impact hand tool is very wide, which is applicable for building cleaning, post-casting modification, opening trunking on wall, tiling, slag cleaning, ice cutting for winter fishing, hacking firewood, picking oyster, surface cleaning of marine facilities, and etc.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An impact hand tool, comprising:

an outer sleeve having a central opening at a first end open through to a sleeve receiving cavity and defining a vertical center axis;

an impact rod inserted into the sleeve receiving cavity through the central opening at the first end;

a cushion pad provided inside the outer sleeve at the vertical center axis;

a handle connected to a free end of the impact rod;

an inner hole slot provided at a second end of the outer sleeve, wherein the inner hole slot has a hollow body and comprises an inner wall and an internal thread on the inner wall of the inner hole slot; and a tool head installed into the second end of the outer sleeve and secured into position, wherein the tool head comprises a connecting rod, a working head, a connecting sleeve and a working rod portion connecting together to form an integral structure, the connecting rod and the connecting sleeve connected together to form an integral and stepped hollow body defining a connecting cavity, the connecting rod has an outer wall on which an external thread for coupling with the internal thread of the inner hole slot is provided, the connecting sleeve has a connecting sleeve outer wall with an anti-slip surface, the working head and the working rod portion is a one-piece structure, the working rod portion is inserted into connecting cavity of the integral and stepped hollow body formed by the connecting rod and the connecting sleeve, and a rubber filler is provided to fill a gap between the working rod portion and an inner wall of the connecting rod, an impact head provided at one end of the impact rod inside the outer sleeve has a tapered structure, the impact rod and the impact head is a one-piece structure, and an outer diameter of a large diameter end of the impact head is larger than an inner diameter of the central opening of the outer sleeve.

2. The impact hand tool according to claim 1, wherein the cushion pad is a rubber pad having a shape selected from the group consisting of a circular shape, a square shape and a plum shape, and a square shape and has an overall thickness of 3-10 mm and a periphery portion adhered to an inner wall of the outer sleeve.

3. The impact hand tool according to claim 1, wherein the working head is a shovel body having a flat trapezoidal structure, a cutting edge provided at a front end thereof, and a working hole provided at a junction between the working head and the connecting rod.

4. The impact hand tool according to claim 1, wherein the working head is a shovel body having a flat polygonal structure, a concave cutting edge with a curvature of 150-170° provided at a front end thereof, and a working hole provided at a junction between the working head and the connecting rod.

5. The impact hand tool according to claim 1, wherein the working head is a prismatic structure with a polygonal cross-section, and a working hole provided at a junction between the working head and the connecting rod.

6. The impact hand tool according to claim 5, wherein the working head has a triangular pyramid or a quadrangular pyramid structure.

7. The impact hand tool according to claim 1, wherein the inner hole slot has a bottom portion and a filler layer having a thickness of 1-3 mm for buffering is provided at the bottom portion of the inner hole slot.

8. The impact hand tool according to claim 1, wherein an end plate is provided at the free end of the connecting rod, and a central portion of the end plate is an outward circular protrusion; a length of the working rod is greater than a length of the connecting rod by 0.5-1 mm and a protruded portion of the working rod is defined and positioned inside the outward circular protrusion; the outward circular protrusion is in direct contact with the cushion pad.

* * * * *